US009541352B2

(12) United States Patent
Hamilton

(10) Patent No.: US 9,541,352 B2
(45) Date of Patent: Jan. 10, 2017

(54) PERSONAL DEFENSE ACCESSORY FOR A MOBILE COMMUNICATIONS DEVICE

(71) Applicant: Christopher C. Hamilton, Kirkland, WA (US)

(72) Inventor: Christopher C. Hamilton, Kirkland, WA (US)

( * ) Notice: Subject to any disclaimer, the term of this patent is extended or adjusted under 35 U.S.C. 154(b) by 274 days.

(21) Appl. No.: 14/210,407

(22) Filed: Mar. 13, 2014

(65) Prior Publication Data

US 2014/0268477 A1 Sep. 18, 2014

Related U.S. Application Data

(60) Provisional application No. 61/782,857, filed on Mar. 14, 2013.

(51) Int. Cl.
*F41H 13/00* (2006.01)

(52) U.S. Cl.
CPC ..... *F41H 13/0018* (2013.01)

(58) Field of Classification Search
CPC ..... F41H 13/0012; F41H 13/0018
USPC ..... 361/232
See application file for complete search history.

(56) References Cited

U.S. PATENT DOCUMENTS 5,988,450 A * 11/1999 Cassarino ..... F41H 9/10 222/192
9,094,100 B2 * 7/2015 Monti ..... H04M 11/04
2004/0156163 A1 * 8/2004 Nerheim ..... F41C 3/00 361/232
2004/0192423 A1 * 9/2004 Nevermann ..... G04G 21/00 455/575.6
2008/0106841 A1 * 5/2008 Nerheim ..... F41H 13/0012 361/232
2010/0231776 A1 * 9/2010 Li ..... F41H 13/0018 348/333.01
2013/0092565 A1 * 4/2013 Swope ..... F41H 13/0018 206/216
2013/0279065 A1 * 10/2013 Froom ..... F41H 13/0018 361/232
2013/0294005 A1 * 11/2013 Garaycochea ..... F41H 13/0018 361/232

OTHER PUBLICATIONS

"iPhone Cases with Concealed Stun Gun for Personal Protection & Battery Charger—Yellow Jacket." iPhone Cases with Concealed Stun Gun for Personal Protection & Battery Charger—Yellow Jacket. N.p., n.d. Web. May 8, 2014; http://www.yellowjacketcase.com/.

* cited by examiner

*Primary Examiner* — Stephen W Jackson
*Assistant Examiner* — Christopher Clark
(74) *Attorney, Agent, or Firm* — Black, McCuskey, Souers & Arbaugh, LPA

(57) ABSTRACT

A personal defense accessory for interaction with a mobile communications device includes a main housing. A pair of electrodes are disposed in the main housing. A controller is disposed with the main housing and connected to the pair of electrodes to deliver a stun rated shock.

13 Claims, 6 Drawing Sheets

PERSONAL DEFENSE ACCESSORY FOR A MOBILE COMMUNICATIONS DEVICE

CROSS-REFERENCE TO RELATED APPLICATIONS

This application claims priority to and the benefit of U.S. Provisional Application No. 61/782,857, filed Mar. 14, 2013, the disclosures of which are incorporated herein in their entirety by reference.

BACKGROUND

This invention relates in general to personal defense and mobile communication devices.

One kind of known personal defense device is the electroshock weapon. Generally, an electroshock weapon is a device that incapacitates a person by administering electric shock. One type of electroshock weapon includes projectiles tethered by thin flexible wire that deliver a shock from a power source disposed in a main housing. Another type of electroshock weapon includes electrodes disposed in the housing for shock by direct contact. Examples of such weapons include stun guns and stun batons.

Generally, however, most people do not carry a weapon on their person at all times while away from home. If an armed attacker confronts such a person, the person may be at a serious disadvantage.

A large number of people do, however, often carry a mobile communications device, such a mobile phone or cellular phone, a smart phone, PDA or other portable personal communications device. These devices generally allow a user free mobility while using the device. When not in use, a user typically keeps the device in his or her pocket, handbag, or holster. This way, the device may be readily available should the individual need to use the device.

While useful for keeping in contact with people, or other communication, while not at home, a mobile communication device is not especially advantageous for defending oneself if the situation should arise. In such a situation, such a device may principally be used to contact help. However, this generally requires that the potential victim to ward off his or her attacker long enough to initiate such contact with the device.

SUMMARY

This invention relates to a personal defense system. The personal defense system includes a mobile communications device with an electrical port and a central processing unit. The personal defense system also includes a personal defense accessory with a main housing attached to the mobile communications device. The personal defense accessory has a pair of electrodes disposed in the main housing, a controller disposed with the main housing an connected to the pair of electrodes to deliver a stun rated shock, and an electrical port disposed in the main housing and connected to the electrical port in the mobile communications device for transmission of data between the controller and the central processing unit. The central processing unit runs a software application to either control, monitor, or control and monitor a state of the personal defense accessory.

The software application may be configured to output data to a display of the mobile communications device regarding the state of the personal defense accessory.

The mobile communications device may further includes a battery to provide the power for the stun rated shock through the electrical ports.

The personal defense accessory may further includes a battery disposed in the main housing to provide the power for the stun rated shock.

The central processing unit and the controller transmit and receive data through the electrical ports.

The personal defense accessory further includes a trigger disposed in the main housing and connected to the controller for activating the stun rated shock.

The personal defense accessory further includes a battery disposed with the main housing and connected to the controller to provide the power for the stun rated shock.

The software application may be responsive to the actuation of stun rated shock to perform at least one communication operation with the mobile communications device.

Various aspects will become apparent to those skilled in the art from the following detailed description and the accompanying drawings.

DETAILED DESCRIPTION

Figure 1:
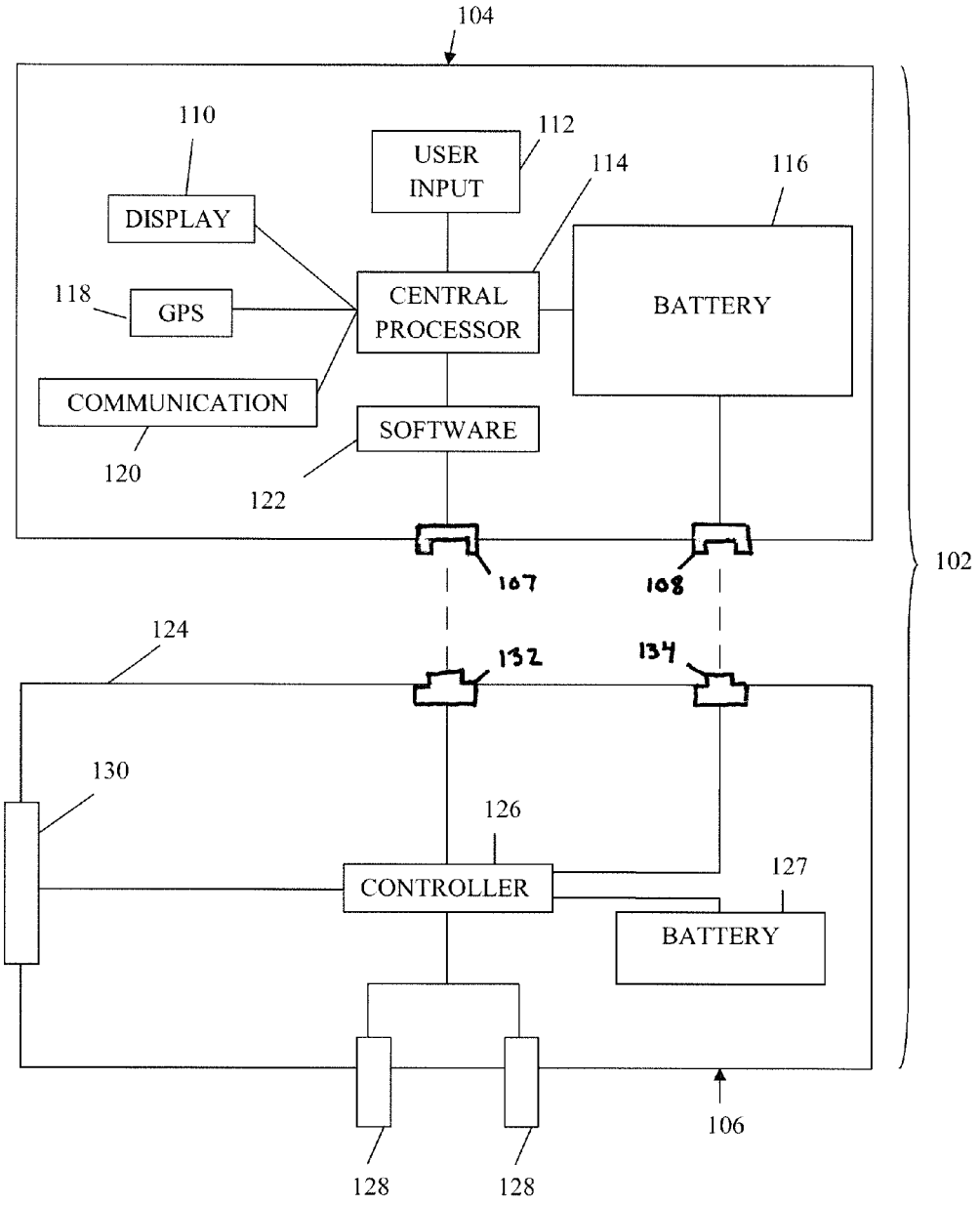
FIG. 1 is a schematic diagram of mobile communication personal defense system.
Figure 2:
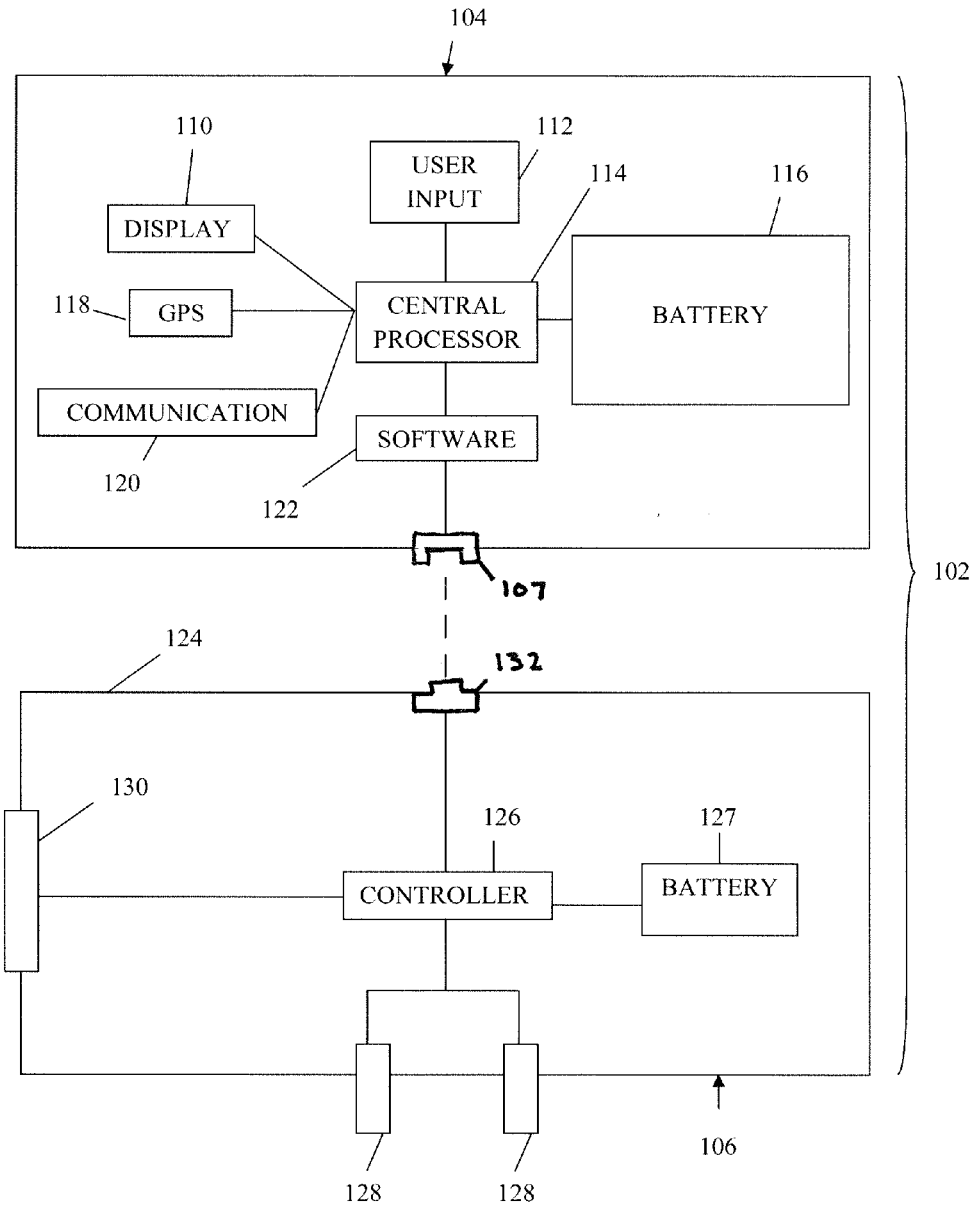
FIG. 2 is a schematic diagram of another mobile communication personal defense system.
Figure 3:
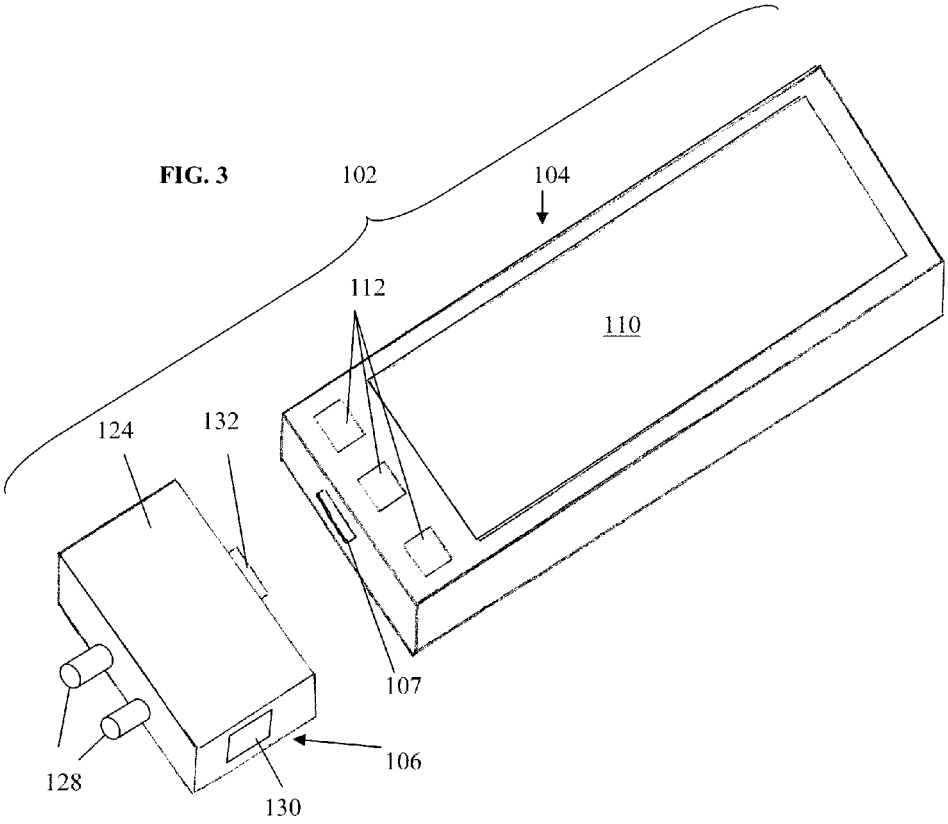
FIG. 3 is a perspective view of the mobile communication personal defense system of FIG. 2 with the personal defense accessory dethatched.
Figure 4:
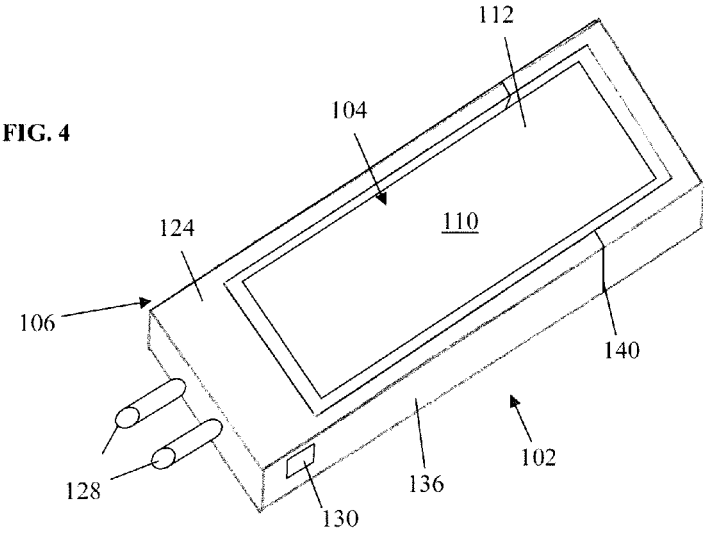
FIG. 4 is a perspective view of yet another mobile communication personal defense system.
Figure 5:
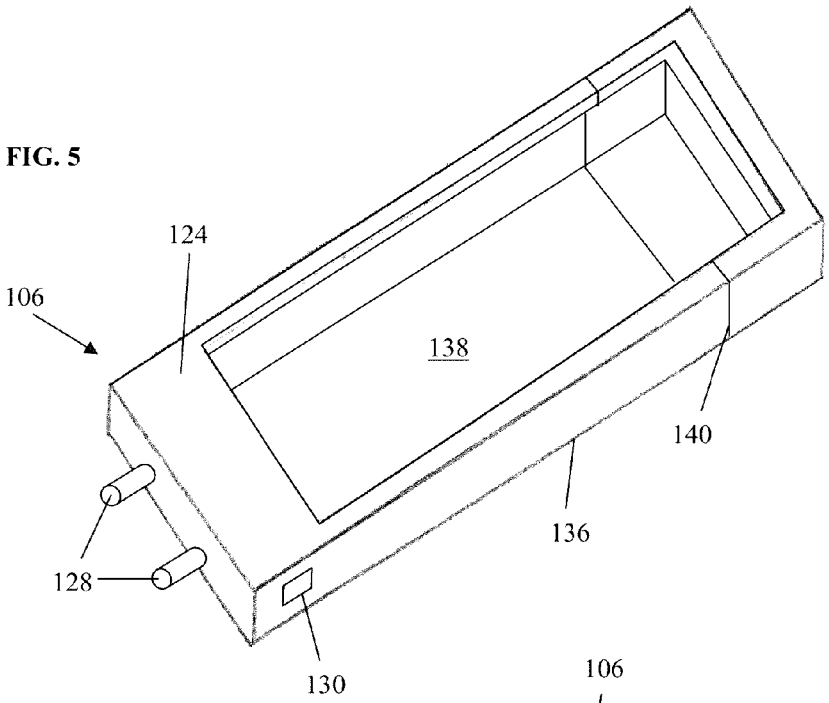
FIG. 5 is a view similar to FIG. 4 with the mobile communication device removed.
Figure 6:
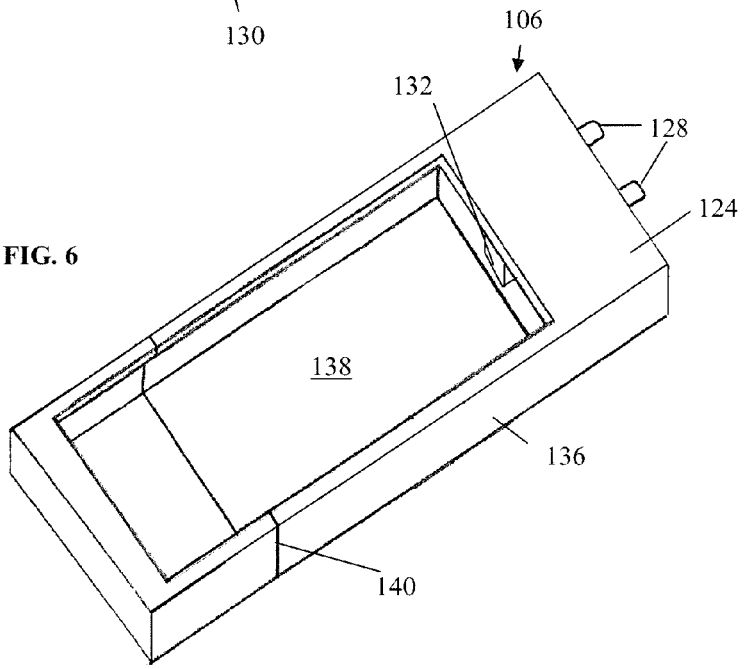
FIG. 6 is a rotated perspective view of the personal defense accessory of FIG. 5.
Figure 7:
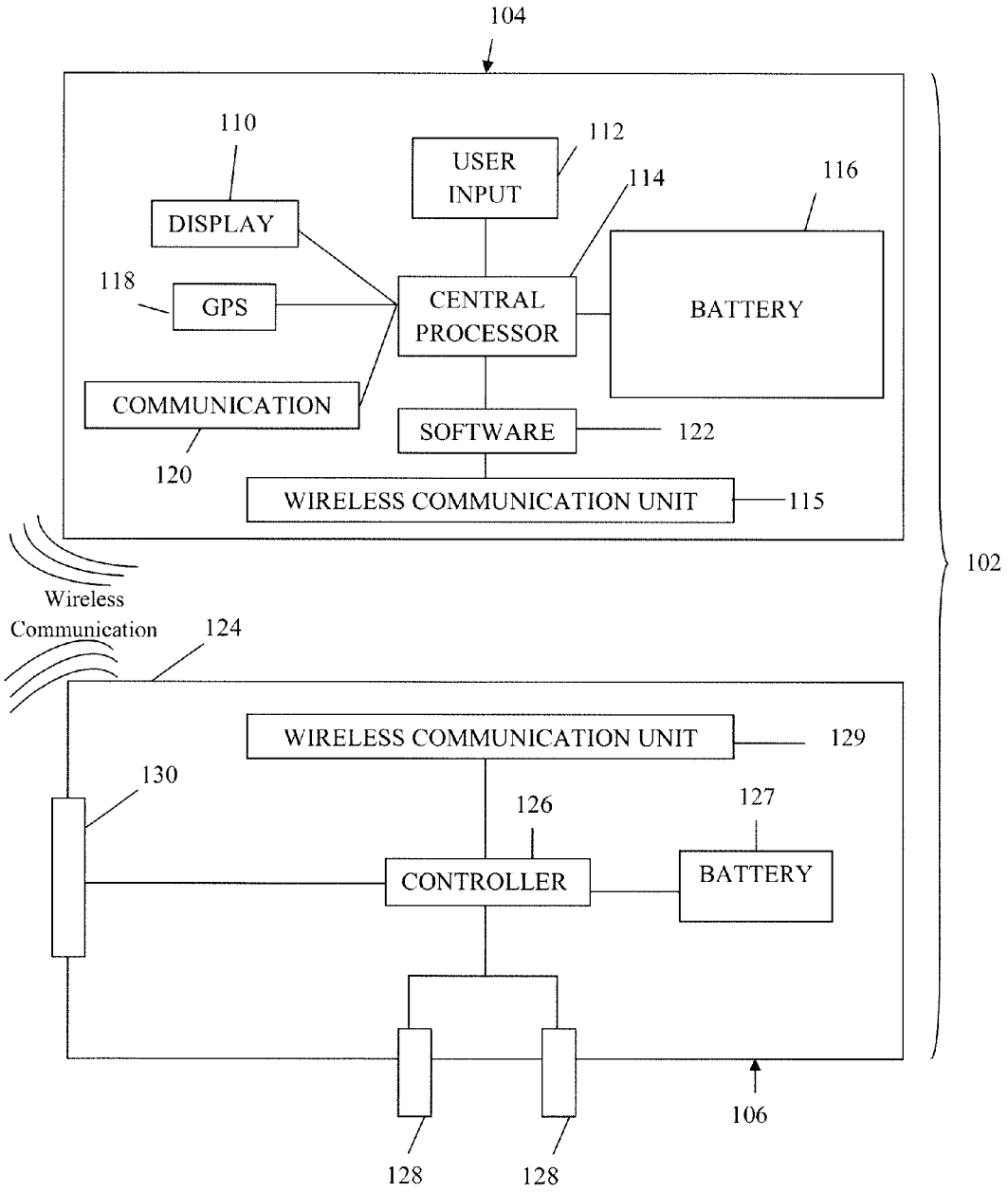
FIG. 7 is a schematic diagram of a further mobile communication personal defense system.
Figure 8:
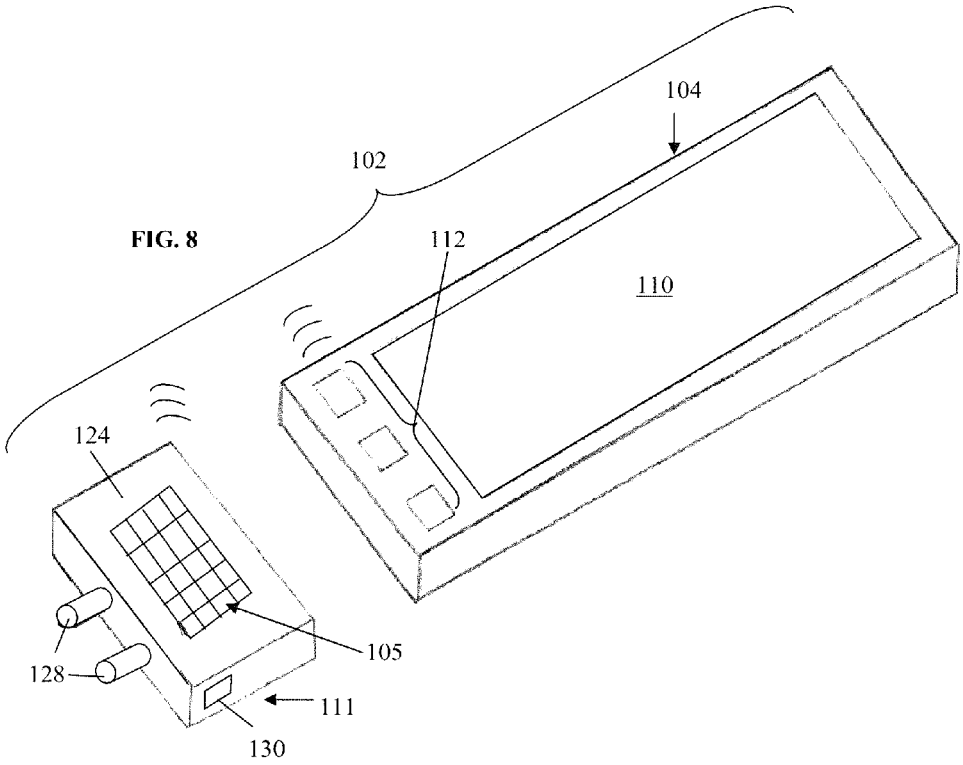
FIG. 8 is a perspective view of an additional mobile communication personal defense system.

Referring now to the drawings, there is illustrated in FIG. 1-8 various embodiments of a personal defense system 102. Like reference numerals in various drawings designate similar or corresponding parts throughout the several views. However, the inclusion of like elements in different views does not mean a given embodiment necessarily includes such elements or that all embodiments include such elements.

The personal defense system 102 includes a mobile communications device 104 and a personal defense accessory 106. The mobile communications device 104 may be a mobile phone or cellular phone, a smart phone, a personal data assistant (PDA) or other portable personal communications device. The mobile communication device 104

The mobile communications device 104 includes at least a first electrical port 107 and may include an optional second electrical port 108. The electrical ports 107 and 108 may each be configured for data transfer, power transfer or booth as desired. The mobile communications device 104 also includes a display 110 and a user interface 112, which may or may not be integrated together.

The mobile communications device 104 further includes a central processing unit 114 for operation of the mobile communications device 104. The mobile communications device 104 also includes a power source, such as a battery 116 to power the mobile communications device 104.

The mobile communications device 104 may also include a Global Positioning System (GPS) module 118 for the determination of location, and a communication module 120 to enable communications on the mobile communications device 104.

Additionally, the mobile communications device 104 may also include personal defense software 122, as will be further described below.

The personal defense accessory 106 has a main housing 124 which is configured to be attached to the mobile communications device 104. The personal defense accessory 106 has a controller 126 disposed with the main housing 124. The personal defense accessory 106 may includes an optional self contained power source, such as a battery 127, disposed within the main housing 124. A pair of electrodes 128 disposed in the main housing 124 and are connected to the controller 126 to deliver a stun rated shock from a power source, such as the battery 127, or as will otherwise be discussed below. The personal defense accessory 106 may also include an optional trigger 130 to actuate the delivery of the stun rated shock. However, it must be understood that any suitable actuation mechanism may be utilized.

The personal defense accessory 106 includes at least a first electrical port 132 and may include an optional second electrical port 134 disposed in the main housing 124 The electrical ports 132 and 134 may each be configured for data transfer, power transfer or booth as desired. The electrical ports 132 and 134 of the personal defense accessory 106 are connected respectively to the electrical ports 107 and 108 of the mobile communications device 104 for transmission of data between the controller 126 and the central processing unit 114. The central processing unit 114 may run the personal defense software 122 to either control, monitor, or control and monitor a state of the personal defense accessory 106.

The personal defense software 122 may be configured to output data to the display 110 of the mobile communications device 104 regarding the state of the personal defense accessory 106. The personal defense software 122 may be responsive to the actuation of stun rated shock to perform at least one communication operation with the mobile communications device 104, such as place an emergency phone call, make an emergency text or send an emergency email, or any other suitable communication operation.

The battery 116 of the mobile communications device 104 may provide the power for the stun rated shock through the electrical ports 107, 108, 132, and 134.

The main housing 124 may also form a case 136 defining a recess 138 to house the mobile communications device 104. The case 136 may be formed of resiliently deformable material, such as an elastomeric rubber or silicone rubber, to fit around the mobile communications device 104, Alternatively the case 136 may be generally rigid and fit around the mobile communications deice 104 in fixable pieces, such as with a snap interface 140. It must be understood that the preceding examples are merely illustrative and not intended to be limiting. Any suitable configuration of the case 136 may be used so as to house the mobile communications device 104.

In various embodiments, the personal defense software 122 may discharge, charge, make safe, or provide other additional services related to the personal defense accessory 106.

In various embodiments, the personal defense accessory 106 may be activated by the trigger 130 or the personal defense software 122.

In various embodiments, the personal defense accessory 106 may utilize power from an internal power source, such as the battery 127 of the personal defense accessory 106, and/or may utilize power from an external source, such as the battery 116 of the mobile communications device 104.

In various embodiments, the personal defense accessory 106 may include a wireless communication unit 129 configured for wireless data transfer through at least one mode of wireless communication such as but not limited to Wi-Fi, Bluetooth or any other mode suitable for communication for electronic data transfer. Using the wireless communication unit 129 the personal defense accessory 106 may wirelessly communicate with a mobile communications device 104 equipped with a wireless communication unit 115 capable wireless data transfer through the same wireless communication mode as the personal defense accessory 106.

In various embodiments, the personal defense accessory 106 may be integrated with a mobile peripheral device or user input device 105 such as a wireless keyboard or other peripheral device suitable for user input with a mobile communication device 104. The mobile peripheral device 105 may contain a wireless communication unit 129 configured for wireless data transfer through at least one mode of wireless communication such as but not limited to Wi-Fi, Bluetooth or any other mode suitable for communication for electronic data transfer. Using the wireless communication unit 129 the personal defense accessory 106 may wirelessly communicate with a mobile communications device 104 equipped with a wireless communication unit 115 capable wireless data transfer through the same wireless communication mode as the personal defense accessory 106.

In various embodiments, the mobile peripheral device with integrated personal defense accessory 111 may be indirectly attached to the mobile communication device 104 via an accessory designed to hold both the mobile communications device 104 and the mobile peripheral device with integrated personal defense accessory 111. The mobile peripheral device with integrated personal defense accessory 111 indirectly attached in the aforementioned manner may be wirelessly connected to the mobile communication device 104.

The personal defense accessory 106 may be integrated into an accessory such as a wallet, or purse. The personal defense accessory 106 may be indirectly attached to the mobile communication device 104 via a compartment designed to hold the mobile communications device 104. The compartment may be a sleeve, holster or holder. The personal defense accessory 106 indirectly attached in the aforementioned manner may be wirelessly connected to the mobile communication device 104.

While principles and modes of operation have been explained and illustrated with regard to particular embodiments, it must be understood, however, that this may be practiced otherwise than as specifically explained and illustrated without departing from its spirit or scope.

What is claimed is:

1. A personal defense system comprising:

a mobile communications device including:

a central processing unit, and a personal defense accessory including:

a main housing, a pair of electrodes disposed in the main housing, and a controller disposed with the main housing and connected to the pair of electrodes to deliver a stun rated shock, where the mobile communications device and the personal defense accessory are in communication for transmission of data between the controller and the central processing unit, and where the central processing unit is running a software application to one of control or monitor a state of the personal defense accessory.

2. The personal defense system of claim 1 where the software application is configured to output data to a display of the mobile communications device regarding the state of the personal defense accessory.

3. The personal defense system of claim 1 where the mobile communications device further includes a battery to provide the power to the personal defense accessory for the stun rated shock through coupled electrical ports.

4. The personal defense system of claim 1 where the personal defense accessory further includes a battery disposed in the main housing to provide the power for the stun rated shock.

5. The personal defense system of claim 1 where the central processing unit and the controller transmit and receive data through coupled electrical ports.

6. The personal defense system of claim 1 where the personal defense accessory further includes a trigger disposed in the main housing and connected to the controller for activating the stun rated shock.

7. The personal defense system of claim 1 where the personal defense accessory further includes a battery disposed with the main housing and connected to the controller to provide the power for the stun rated shock.

8. The personal defense system of claim 1 where the software application is responsive to actuation of stun rated shock to perform at least one communication operation with the mobile communications device.

9. The personal defense system of claim 1 where the main housing is attached to the mobile communications device.

10. The personal defense system of claim 1 where the mobile communications device includes an electrical port, and where the personal defense accessory includes an electrical port disposed in the main housing and connected to the electrical port in the mobile communications device for transmission of data between the controller and the central processing unit.

11. The personal defense system of claim 1 where the mobile communications device and the personal defense accessory are in wireless communication.

12. The personal defense system of claim 1 where the personal defense accessory includes a user input device for the mobile communications device.

13. The personal defense system of claim 12 where the user input device is a keyboard.

* * * * *